US006752364B1

(12) United States Patent
Lim

(10) Patent No.: US 6,752,364 B1
(45) Date of Patent: Jun. 22, 2004

(54) COLLAPSIBLE FRAME FOR FURNITURE

(75) Inventor: Kok Jit Lim, Jamestown, NC (US)

(73) Assignee: S.V. International Corporation, Greensboro, NC (US)

( * ) Notice: Subject to any disclaimer, the term of this patent is extended or adjusted under 35 U.S.C. 154(b) by 0 days.

(21) Appl. No.: 10/037,855

(22) Filed: Jan. 7, 2002

(51) Int. Cl.[7] ..... F16M 11/38

(52) U.S. Cl. ..... 248/188.6; 248/346.3; 297/452.18; 297/440.1

(58) Field of Search ..... 16/369, 365, 366, 16/368; 312/258, 257.1, 351.6, 351.7; 108/115, 51.3, 56.1; 297/452.18, 219.1, 450.1, 451.7, 440.1; 5/174, 176.1; 248/188.6, 346.3, 97; 135/377, 381, 368.1

(56) References Cited

U.S. PATENT DOCUMENTS 434,753 A * 8/1890 Barrows ..... 4/236
1,157,065 A * 10/1915 Todd ..... 16/365
3,591,176 A * 7/1971 Roth ..... 473/3
4,361,180 A * 11/1982 Stuvecke ..... 160/377
4,537,376 A * 8/1985 Buku ..... 248/97
5,911,653 A * 6/1999 Cheng ..... 5/99.1
5,943,968 A * 8/1999 Dobson et al. ..... 108/124

* cited by examiner

*Primary Examiner*—James O. Hansen

(57) ABSTRACT

The invention herein pertains in certain embodiments to furniture construction utilizing frames which are attached to upper sections of chairs, loveseats, sofas and the like. The frames are collapsible for shipping and storage and can be quickly expanded through the use of hinged joints. The preferred form of the invention utilizes dual pivoting hinges whereas an alternative embodiment utilizes multiple single pivoting hinges and ring members for constructing furniture frames. In another embodiment, case goods may employ a collapsible frame as described herein.

2 Claims, 5 Drawing Sheets

COLLAPSIBLE FRAME FOR FURNITURE

FIELD OF THE INVENTION

The invention herein pertains to furniture construction and in particular pertains to the manufacture of upholstered chairs, sofas, loveseats, case goods such as dressers and the like which utilize frames.

DESCRIPTION OF THE PRIOR ART AND OBJECTIVES OF THE INVENTION

Certain furniture is conventionally manufactured by forming an upper section such as in the manufacture of a chair whereby the back, sides and bottom have assembled wooden internal components which are then covered in part with resilient foam padding. The padded foam is then covered with a suitable outer fabric. This upholstered upper section is then inverted and a decorative wooden frame having legs or corner blocks for subsequent leg attachment is attached as with screws, bolts or other fasteners. Manufacture of furniture in this manner has been proven economical and cost-effective. Upholstered furniture manufacturers bulk purchase attractive decorative frames generally preassembled in rectangular fashion and add legs of their choice. Such legs generally come with threaded studs for easy assembly into threaded fasteners affixed to the corner blocks of the preassembled frames. Thus by changing the frame, fabrics and leg designs, any of a large variety of particular furniture items such as chairs can be offered to retail stores on a custom basis. Case goods such as dressers also have frames used in the construction thereof.

Preassembled frames are generally shaped to fit a particular size furniture item. When shipped from long distances, their cost quickly escalates due to both the weight of the frames and the volume of space occupied. This is of particular concern when such frames are transported by ship or airplane, at which time the volume of the shipment is of maximum concern. Furniture manufacturers want preassembled frames delivered quickly on demand, but are extremely cost conscious in today's competitive market.

Thus, with the problems and disadvantages associated with conventional preassembled frames and methods of furniture manufacture utilizing the same, the present invention was conceived and one of its objectives is to provide a frame base for an upholstered chair, dresser or other item which can be shipped long distances in a collapsed or compact fashion to reduce the shipping costs.

It is another objective of the present invention to provide an upholstered furniture frame which is attractive to use and relatively inexpensive to transport.

It is still another objective of the present invention to provide a rigid stable frame which has hinged joints for quickly expanding it from a collapsed storage posture.

It is yet a further objective of the present invention to provide a furniture frame which utilizes legs which can be easily attached as needed.

It is still another objective of the present invention to provide a dual pivot hinge in a first preferred embodiment for use in the construction of a furniture frame.

It is yet another objective of the present invention to provide a furniture frame which utilizes a single-action hinge in a second embodiment of the invention.

Various other objectives and advantages of the present invention will become apparent to those skilled in the art as a more detailed description is set forth below.

SUMMARY OF THE INVENTION

The aforesaid and other objectives can be realized by providing a frame for upholstered furniture such as chairs, dressers and other items which includes a front, a rear and two side rails formed of a solid wood, chipboard or other materials such as plastic which is preferably joined at the corners by a dual pivot hinge. The dual pivot hinge includes a pair of short end sections which are pivotally joined to a planar central section, when used as a base for upholstered chairs having apertures therein for attachment of a leg or corner block. Each end of each of the rails include a projecting lip which is positioned in each one of a pair of, for example vertical grooves in the leg. Thus, frames which are received in a collapsed posture are opened or extended to a substantially rectangular configuration, the legs attached and the frame is then complete for mounting on a selected upholstered upper section such as for a chair. Once the frame is so affixed, the chair is then ready for delivery to a retail store or otherwise.

In a second embodiment of the invention, a frame for upholstered furniture, a single-pivot hinge is attached to the base rails. A hook on the center section of the hinge is joined to a ring member which can be of various shapes on the adjoining rail during assembly to form the rectangular frame. Legs are attached to the central section of the hinge as in the preferred embodiment to likewise form a rigid, stable attractive, exposed frame for use with upholstered furniture upper sections. Case goods generally have rigid main frames which could also be made using the collapsible features used herein.

DETAILED DESCRIPTION OF THE PREFERRED EMBODIMENT AND OPERATION OF THE INVENTION

Figure 2:
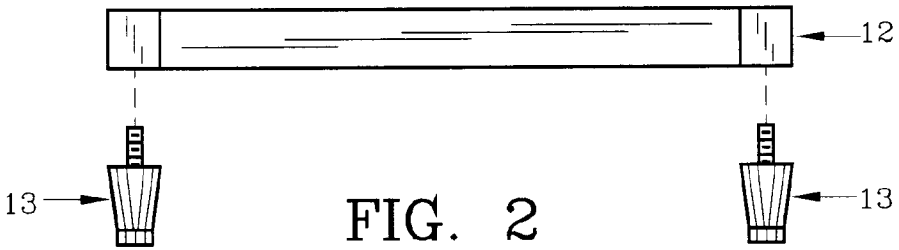
FIG. 2 (PRIOR ART)
FIG. 2 illustrates the frame as shown in FIG. 1 as removed from the upholstered chair upper section with the legs exploded from the corner blocks.
Figure 1:
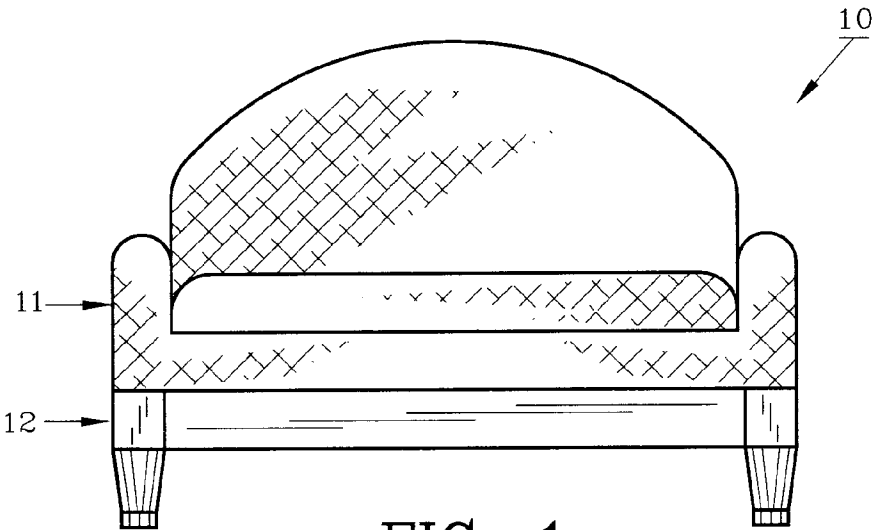
FIG. 1 (PRIOR ART)
FIG. 1 demonstrates a conventional chair as manufactured using a standard preassembled frame.
Figure 4:
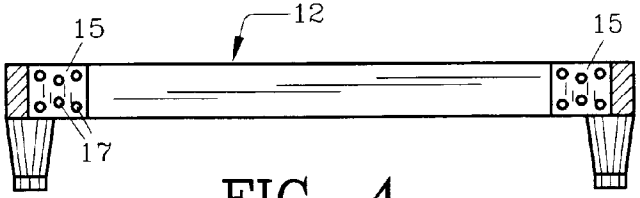
FIG. 4 (PRIOR ART)
FIG. 4 shows the conventional frame of FIG. 3 along lines 4—4 thereof.
Figure 3:
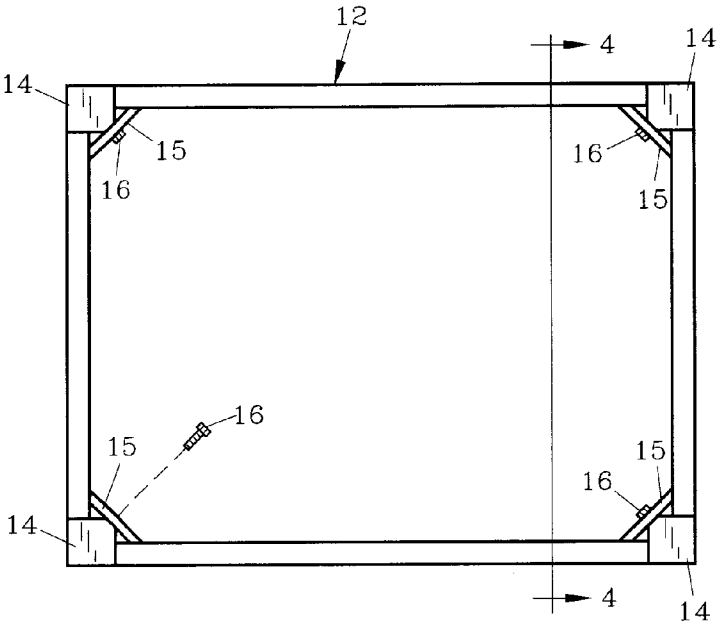
FIG. 3 (PRIOR ART)
FIG. 3 depicts a top view of the frame as shown in FIG. 2.

For a better understanding of the invention and its operation, turning now to the drawings, FIGS. 1–5 illustrate a certain prior art upholstered furniture frame and methods of assembly. As seen, in FIGS. 1–5, finished upholstered chair 10 includes an upper portion 11 of standard design with preformed or assembled rectangular frame 12 joined thereto. Frame 12 as shown in FIG. 2 is generally shipped and legs 13 having threaded studs are assembled at the chair manufacturing plant. Frame 12 as seen in FIGS. 3 and 4 consist of front, back and side rails which are joined with corner blocks 14 as shown in FIG. 3. Braces 15, which are attached by threaded members 16 further stabilize frame 12. Corner braces 15 often have a plurality of openings 17 therein for wood screws, bolts or other fasteners as also seen in FIG. 4.

As aforementioned, standard frame 12 is assembled and shipped in rectangular form as shown in FIG. 3 as frame frames 12 are generally formed of decorative wood or other dense materials, shipping costs are expensive both because of the weight and of the volume. During assembly, upper upholstered chair portion 11 is generally inverted during assembly as shown in FIG. 5 and frame 12 having legs 13 previously attached is then affixed to upper portions 11 such as by screws 18, bolts, adhesives (not seen) or other fasteners.

Figure 5:
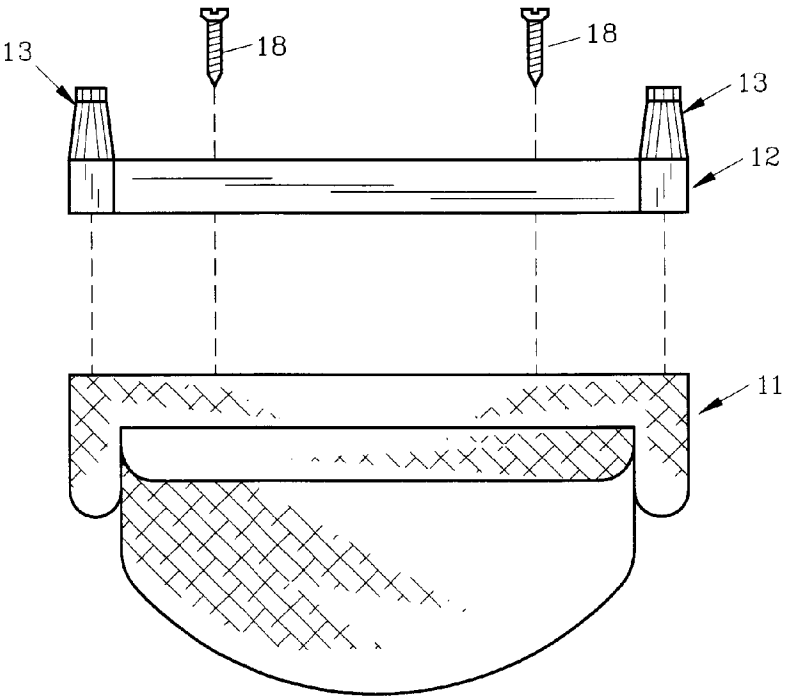
FIG. 5 (PRIOR ART)
FIG. 5 features a step in the conventional assembly method utilizing the assembled frame of FIGS. 2 and 3.
Figure 6:
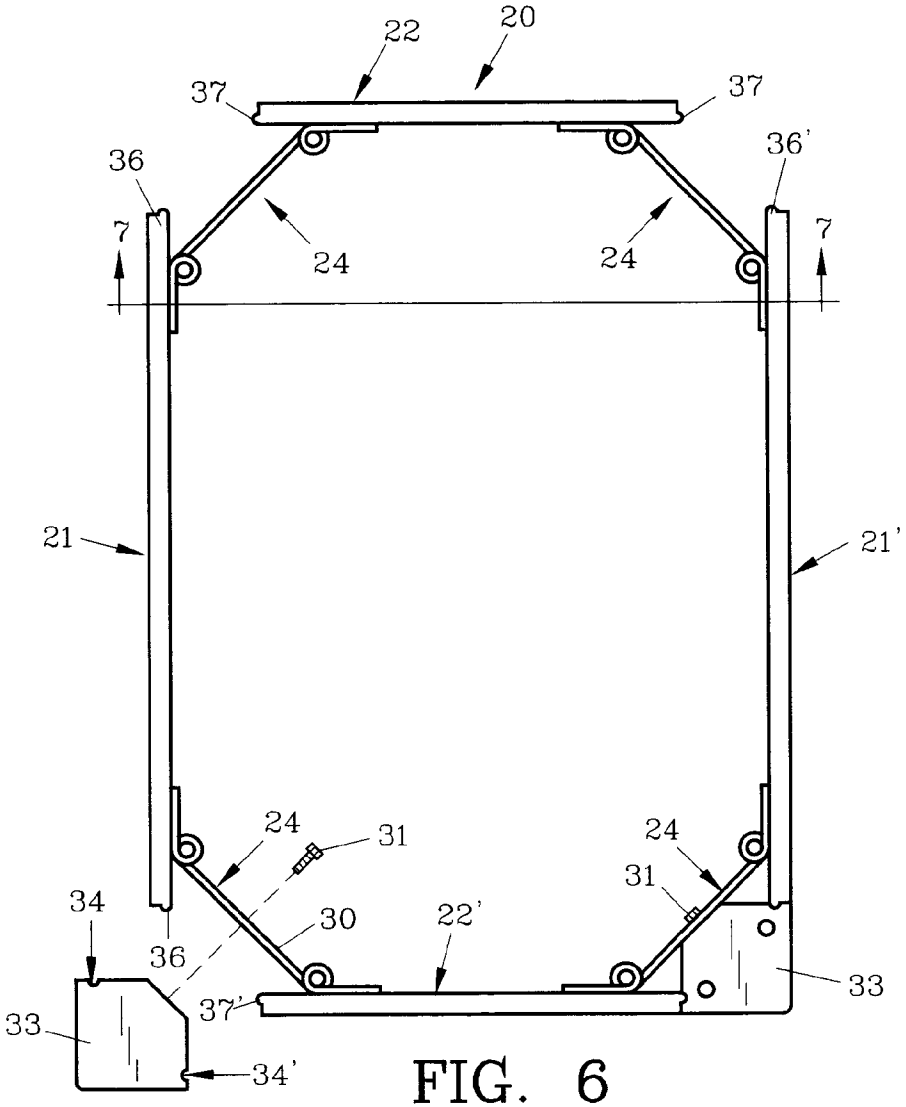
FIG. 6 pictures a top view of the preferred embodiment of the frame with one leg attached and second leg exploded therefrom.
Figure 7:
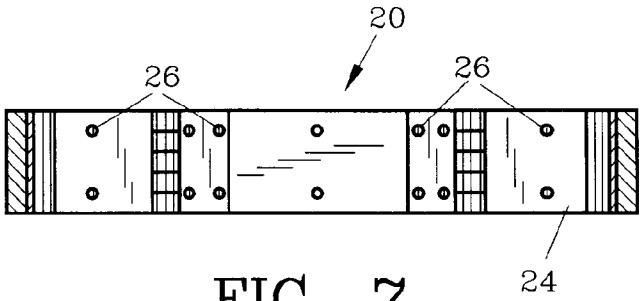
FIG. 7 shows a sectional view of the frame as along lines 7—7 of FIG. 6.
Figure 9:
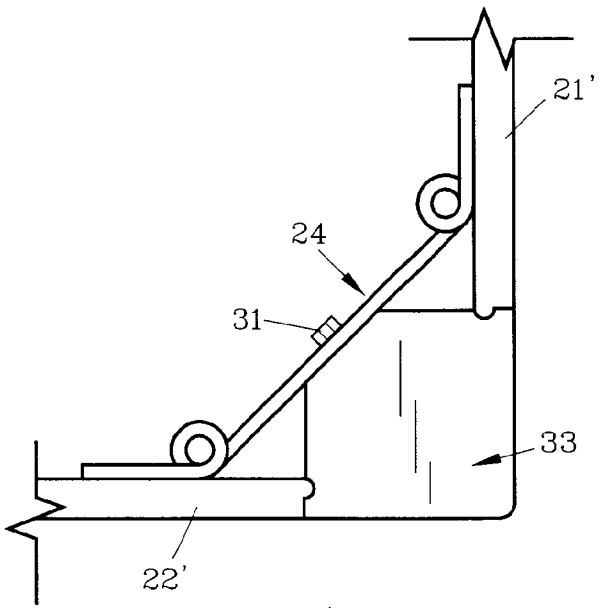
FIG. 9 features an enlarged top view of one corner of the preferred frame assembled.
Figure 10:
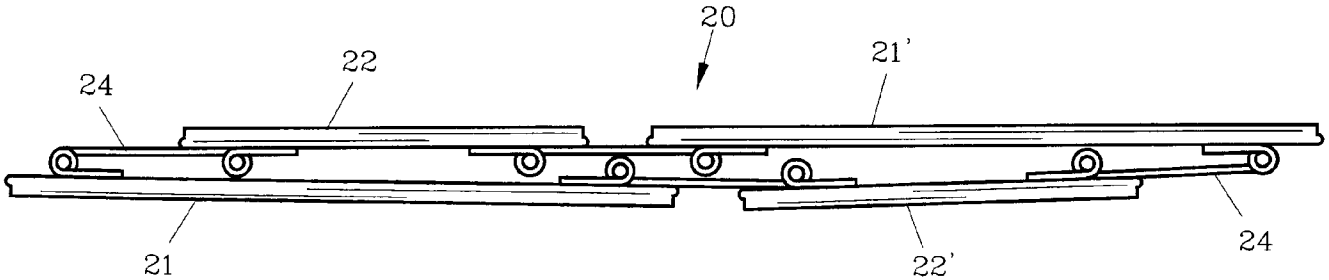
FIG. 10 illustrates the frame as seen in FIG. 6 in a collapsed posture for enduring shipment or storage.
Figure 8:
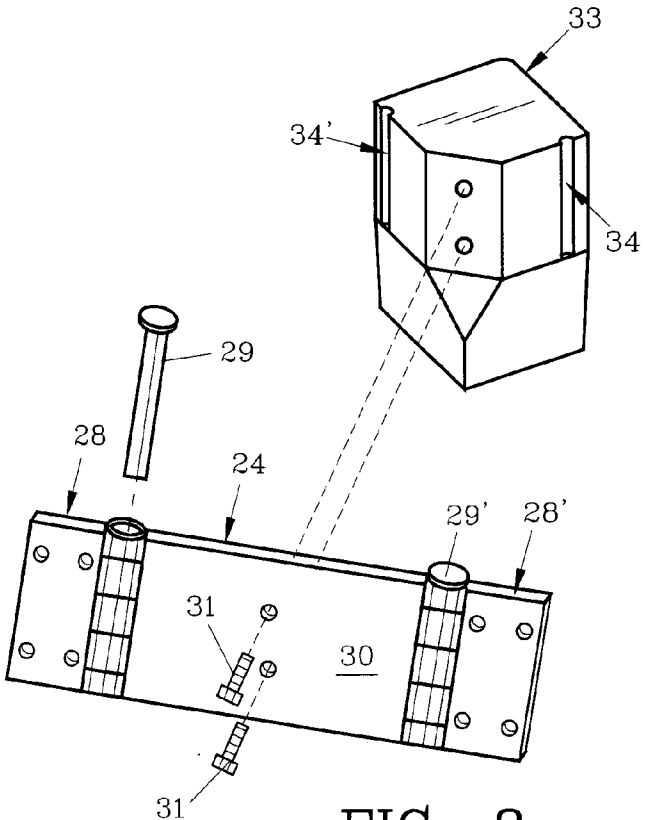
FIG. 8 demonstrates an enlarged view of the dual pivot hinge of the invention with a leg exploded therefrom.

An improvement over conventional upholstered furniture frames is shown in FIGS. 6 through 13, whereby frames 20, 38 are shown. Preferred frame 20 as seen in FIG. 6, comprises front rail 21 which may be formed of wood or other decorative materials, rear rail 21' and side rails 22, 22'. Connecting side rails 22, 22' to front and rear rails 21, 21' are four dual pivot hinges 24, which are affixed to rails 21, 21', 22, 22' by threaded members such as wood screws 26 as seen in FIG. 7. Dual pivot hinges 24 are affixed to front and side rails 21, 21', 22, 22' respectively and then delivered in compact fashion as seen in FIG. 10 after packaging to an upholstered chair manufacturer. Such delivery may include transportation by planes, ships, trucks or the like. Due to the compact shipping configuration as shown in FIG. 10, frame 20 occupies relatively little volume producing savings in large freight. This savings more than justifies any extra cost in assembly as such frames can be made in foreign venues and compactly transported to the United States or to manufacturing facilities located elsewhere. Once frames 20 arrive in collapsed fashion (FIG. 10), relatively unskilled workers can quickly, manually expand frames 20 into rectangular form as shown in FIG. 6 and attach legs 33 thereto by bolts 31 as shown in FIGS. 8 and 9 or by wood screws or other means of attachment. FIG. 8 shows preferred hinge assembly 24 with leg 33 exploded therefrom. While leg 33 is shown as the preferred form, a separate leg and corner block could also be used as in the prior art examples in FIGS. 1–6.

Dual pivot hinges 24, preferably made of metal, as shown in FIG. 8 include short planar end sections 28, 28', long planar central section 30 and a pair of hinge pins 29, 29' which allow hinge sections 28, 28' to pivot relative to central section 30. As shown in FIG. 6, central section 30 is joined such as with bolts 31 to leg 33. Leg 33 is formed, preferably of solid wood in various designs and shapes and includes grooves 34, 34', which engage front rail lips 36, 36' and side rail lips 37, 37' for improved stability.

Once preferred frame 20 is assembled as explained above, it is now available for positioning on and attaching to upholstered upper chair section 11 such as shown in FIG. 5.

Figure 13:
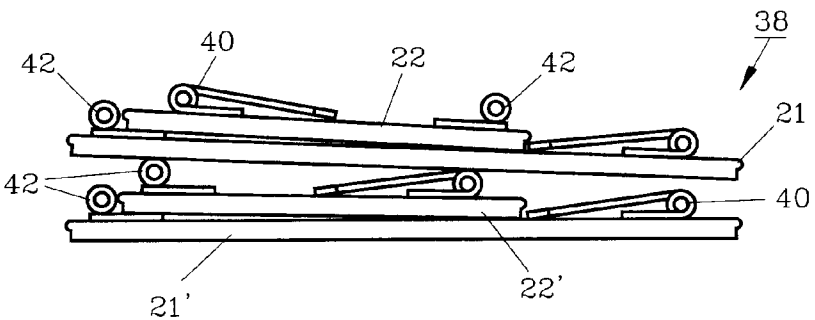
FIG. 13 demonstrates the frame as shown in FIG. 11 in a disassembled, compact fashion such as for shipment purposes.
Figure 11:
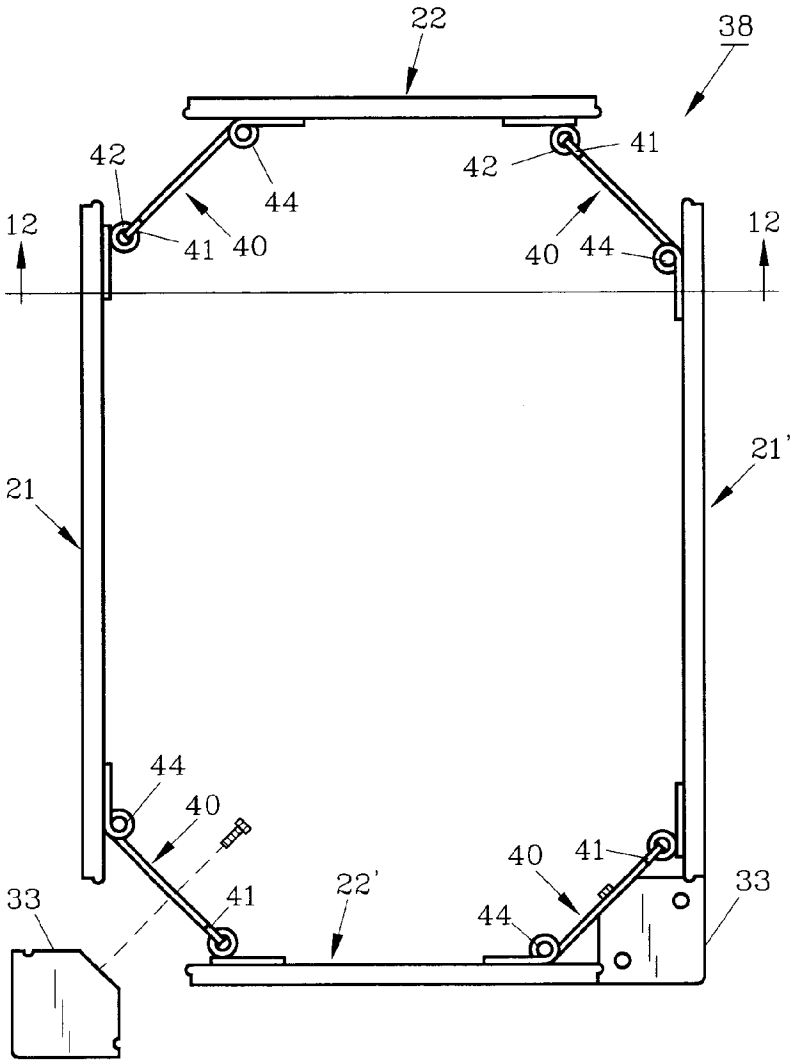
FIG. 11 depicts a second embodiment of the invention utilizing a single-pivot hinge and ring member.
Figure 12:
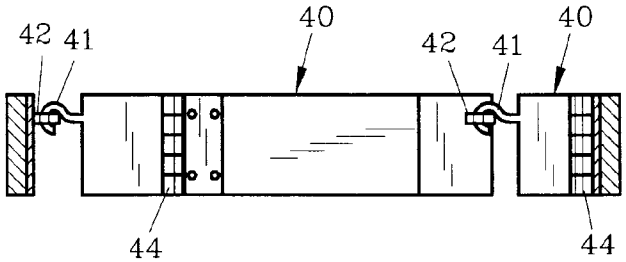
FIG. 12 shows the frame as seen in FIG. 11 along lines 12—12.

An alternative embodiment of the invention is seen in FIGS. 11–13 whereby front and rear frame rails 21, 21' and side rails 22, 22' are joined by single-pivoting hinge 40. Hinge 40 includes a hook 41 which engages ring member 42 as shown in FIG. 12. Leg members could be made in various configurations to accept hook 41. Hinge 40 pivots about joint 44 as hereinbefore described regarding preferred dual pivot hinge 24. In FIG. 13, frame 38 which can be easily disassembled into four sections and packaged by using elastic bands, conventional plastic bands, plastic tie straps or the like (not seen) and compactly stored and transported with hinge 40, completely separated from ring member 42.

The illustrations and examples provided herein are for explanatory purposes, it being realized that those skilled in the art will make modifications, and the included examples are not intended to limit the scope of the appended claims.

I claim:

1. A furniture article comprising: a collapsible rectangular frame, said frame comprising: a front rail, a rear rail, a left side rail and a right side rail, a plurality of dual pivot hinges, each of said rails joined to two different hinges, a plurality of legs, each of said legs joined to different ones of said hinges, said legs each configured for receiving at least one rail and supporting the frame in a rectangular configuration, said rails pivotally joined to allow said frame to collapse to a closed posture when said legs are not joined to the hinges and to open to a rectangular posture, wherein said legs each define a groove for receiving a respective rail.

2. The article of claim 1 further comprising four dual pivot hinges, each of said hinges attached to different pairs of said rails to allow said rails to open and collapse.

* * * * *